US006484074B1

(12) United States Patent
Hazard et al.

(10) Patent No.: US 6,484,074 B1
(45) Date of Patent: Nov. 19, 2002

(54) METHOD OF AND DEVICE FOR CONTROLLING CONTROLLED ELEMENTS OF A RAIL VEHICLE

(75) Inventors: Laurent Hazard, Marcq (FR); Frédéric Vantalon, Asnieres (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/762,468

(22) PCT Filed: Apr. 17, 2000

(86) PCT No.: PCT/FR00/00994

§ 371 (c)(1),
(2), (4) Date: Feb. 7, 2001

(87) PCT Pub. No.: WO00/76827

PCT Pub. Date: Dec. 21, 2000

(30) Foreign Application Priority Data

Jun. 11, 1999 (FR) ..... 99 07435

(51) Int. Cl.[7] ..... B61F 5/24

(52) U.S. Cl. ..... 701/19; 701/25; 701/26; 701/38; 105/199.2

(58) Field of Search ..... 701/19, 20, 24, 701/25, 26, 35, 37, 38, 72; 702/5; 246/182 R, 182 B, 122 R, 167 R; 105/199.2

(56) References Cited

U.S. PATENT DOCUMENTS 5,775,230 A 7/1998 Uwe
5,787,815 A * 8/1998 Andersson et al. ..... 105/199.2
6,119,056 A 9/2000 Beike ..... 701/19

FOREIGN PATENT DOCUMENTS

| | | | |
|---|---|---|---|
| DE | 42 44 624 | 6/1994 | ..... B61L/27/00 |
| EP | 0 271 592 | 6/1988 | ..... B61F/5/22 |
| EP | 0271592 | 6/1988 | |
| EP | 0860340 | 8/1998 | |
| GB | 2306932 | 5/1997 | |

* cited by examiner

*Primary Examiner*—William A. Cuchlinski, Jr.
*Assistant Examiner*—Arthur D. Donnelly
(74) *Attorney, Agent, or Firm*—Sughrue Mion PLLC

(57) ABSTRACT

A method of controlling controlled elements of a rail vehicle, in which method descriptive geometrical characteristics of the rail track are calculated by measuring inertial values on board the vehicle and control set points for said controlled elements are generated from said characteristics, characterized in that it includes the steps of:

determining the location of the vehicle on the rail track on which it is travelling by comparing calculated geometrical characteristics with geometrical characteristics stored in a database (16) and obtained by a learning process;

extracting geometrical characteristics corresponding to the next curve from the database (16); and generating control set points for the controlled elements in advance from the extracted characteristics.

17 Claims, 2 Drawing Sheets

METHOD OF AND DEVICE FOR CONTROLLING CONTROLLED ELEMENTS OF A RAIL VEHICLE

The present invention relates to a method of controlling controlled elements of a rail vehicle, in particular a method of controlling elements intended to improve the comfort of passengers, and also relates to a control device for controlled elements which is adapted to implement the method.

At present there are two main techniques for controlling controlled elements of a rail vehicle which are essentially used to control controlled elements controlling the inclination of a tilting vehicle.

A first technique consists of measuring inertial values, in particular the transverse acceleration, the roll velocity of the vehicle and possibly the yaw velocity of the bogie, calculating from those values geometrical characteristics descriptive of the track on which the vehicle is traveling, and generating control set points from those characteristics, such as the angle of inclination in the case of a tilting train.

The above technique generates relatively accurate angle set points. It has a number of drawbacks, however, in particular because the inclination of the vehicle is out of phase with the curves negotiated by the vehicle in that it does not take account of the time-delay inherent to the processing of the inertial values or the time-delay generated by operation of the tilt drive systems equipping each body of the vehicle and to which the angle set points are transmitted.

The time-delay can be clearly perceptible at speeds from 160 kph in the case of a train with a motor car at the front.

Another prior art technique, which was developed to overcome the above drawback, consists of equipping the rail tracks with beacons for accurately determining the location of the rail vehicle on the track on which it is travelling and transmitting control set points, in particular inclination angle set points in the case of a tilt system, in advance, to compensate the time-delays inherent to the operation of such systems.

The above tilting technique effectively compensates the centrifugal force to which the passengers on the vehicle are subjected because tilting can be applied in phase with the curve being negotiated. It nevertheless has the drawback of making it necessary to equip with beacons all rail tracks of a rail network on which operation in tilt mode is authorized, and its cost is therefore prohibitive.

What is more, it cannot be used on sections of the network that are not equipped with the beacons.

The object of the invention is to overcome these drawbacks by proposing a method of controlling controlled elements of a rail vehicle which enables the controlled elements to be controlled in advance so that their reaction is in phase with the geometry of the rail track, without necessitating additional rail track equipment, in order to be simple and economical to put into practice.

The invention therefore provides a method of controlling controlled elements of a rail vehicle, in which method descriptive geometrical characteristics of the rail track are calculated by measuring inertial values on board the vehicle and control set points for said controlled elements are generated from said characteristics, characterized in that it includes the steps of:

- determining the location of the vehicle on the rail track on which it is travelling by comparing calculated geometrical characteristics with geometrical characteristics stored in a database and obtained by a learning process;
- extracting geometrical characteristics corresponding to the next curve from the database; and

- generating control set points for the controlled elements in advance from the extracted characteristics.

The method according to the invention can further include one or more of the following features, individually or in all technically feasible combinations:

- before generating the control set point(s) of the controlled elements, at least one of the geometrical characteristics calculated is compared to a window for validating the location of the rail vehicle generated from the respective data extracted from the database and corresponding to the presumed location of the rail vehicle and in that if there is no correspondence between the geometrical characteristic(s) calculated and the validation window control set point(s) for the controlled elements are generated from the calculated geometrical characteristics;
- determining the location of the vehicle includes the steps of identifying the rail track on which the vehicle is travelling by comparing the geometrical characteristics calculated with characteristics stored in the database and calculating the distance to the next curve from a measured speed of the rail vehicle and the length of a straight section preceding said curve extracted from the database;
- at least on leaving each curve the location of the vehicle on the rail track is corrected by comparing geometrical characteristics calculated while negotiating the curve with characteristics stored in the database;
- it further includes a step of transmitting the control set point(s) to the controlled elements equipping each car of the rail vehicle at times enabling compensation of the time-delays generated in the operation of said controlled elements and depending on the location of each car in the vehicle;
- the controlled elements are elements of an active suspension;
- the controlled elements are elements controlling the position of orientable axles of a bogie;
- the controlled elements are elements controlling the tilt of a tilting rail vehicle and the control set points are inclination angle set points;
- a weighting coefficient for the inclination of the rail vehicle for each curve extracted from the database is applied to the angle set point(s).

The invention also provides a device for controlling controlled elements of a rail vehicle, of the type including means for measuring inertial values and a computer adapted to calculate descriptive geometrical characteristics of the rail track on which the vehicle is travelling from the measured inertial values and to generate control set points for the controlled elements from the geometrical characteristics calculated, characterized in that the computer includes means for determining the location of the rail vehicle by comparing the geometrical characteristics calculated with geometrical characteristics stored in a database stored in the computer and obtained beforehand by a learning process, the inertial values used to generate the control set point or points corresponding to the next curve being generated in advance from characteristics of that curve extracted from the database in order to control said controlled elements in phase with the curve.

The device according to the invention can further include one or more of the following features, individually or in all technically feasible combinations:

- the controlled elements are elements controlling the inclination of a tilting rail vehicle and the control set points are inclination angle set points for the rail vehicle;

the controlled elements are elements of an active transverse suspension;

the controlled elements are elements controlling the position of orientable axles of a bogie.

Other features and advantages will emerge from the following description of several applications of one embodiment of a control method in accordance with the invention, which description is given by way of example only and with reference to the accompanying drawings, in which:

FIG. 1 shows one particular embodiment of a method according to the invention applied to controlling the tilt of a tilting vehicle. FIG. 1 is a diagrammatic front view of a rail vehicle 10 negotiating a curve in a rail track with a cant d at an angle $\alpha$.

The vehicle 10, and in particular the passengers that it carries, are subjected to the acceleration g due to gravity and to a centrifugal force $V^2/R$, where V and R are respectively the speed of the vehicle and the radius of curvature of the curve being negotiated.

The total force F acting on the passengers is the sum of the acceleration due to gravity and the centrifugal force.

Considering a system of axes (x, y) fixed relative to the vehicle 10, it is clear that the force F has a first transverse component $F_x$ which is uncomfortable for the passengers and can lead to motion sickness and a second component $F_y$ acting in a direction perpendicular to the plane of the track and only slightly perceptible by the passengers.

At low speeds the cant of the rail track can be sufficient to limit the transverse component of the total force F applied to the passengers by the effect of the acceleration due to gravity.

At high speeds tilting rail vehicles apply complementary compensation by tilting toward the inside of the curve so that the action of gravity alone reduces or even cancels out the transverse component of the total force applied to the passengers, depending on the speed of the vehicle.

Figure 1:
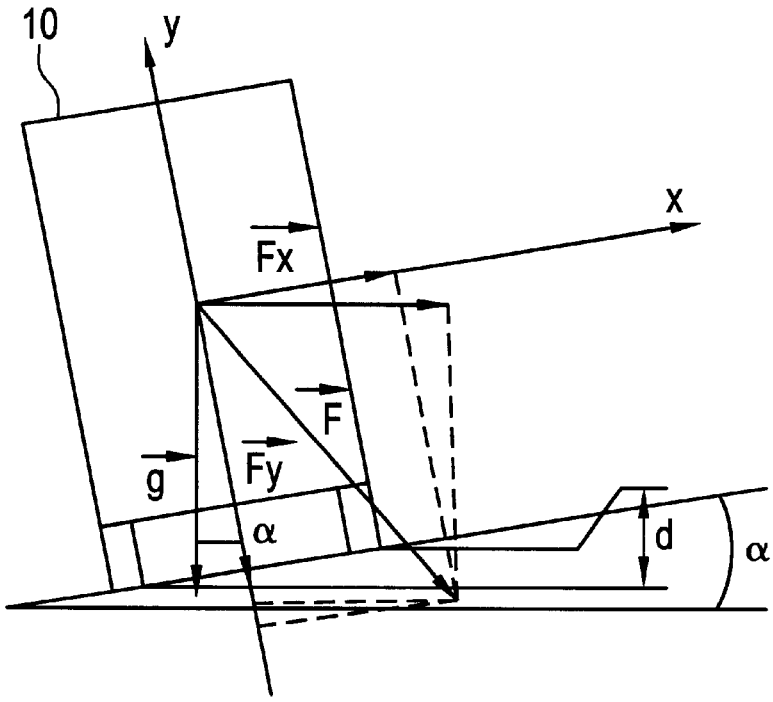
FIG. 1 is a diagram showing the principle of compensating the centrifugal force applied to the passengers of a rail vehicle when the control method according to the invention is applied to controlling the tilt of a tilting vehicle.
Figure 2:
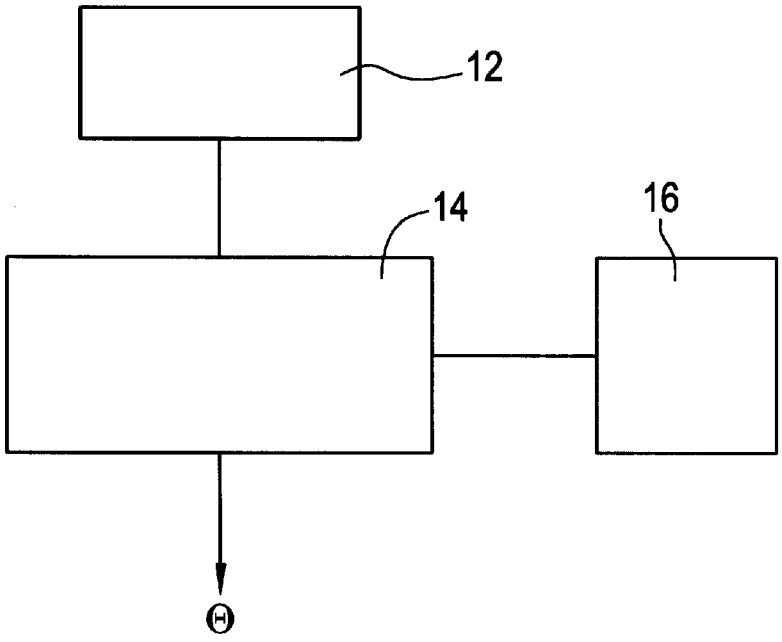
FIG. 2 is a block diagram showing a control device in accordance with the invention for controlling controlled elements.

FIG. 2 is a block diagram of a control device according to the invention.

As can be seen in FIG. 2, the control device includes means 12 for measuring inertial values, in particular the transverse acceleration, the rate of roll and where applicable the rate of yaw of the bogie of the vehicle.

The measuring means 12 are connected to a computer 14 in which is stored an algorithm for calculating geometrical characteristics descriptive of the track on which the rail vehicle is travelling. The algorithm is conventional. It will therefore not be described in detail hereinafter. Note, however, that it is adapted to calculate from the inertial values the geometrical characteristics of the track, in particular the cant and the radius of curvature of the curves negotiated and the skew, in particular from the speed of the vehicle.

The computer 14 is associated with a database 16 in which are stored corresponding descriptive geometrical characteristics obtained by a learning process carried out beforehand by having a rail vehicle travel on the rail tracks of a rail network on which operation in tilting mode is authorized and to which the track on which the rail vehicle travels belongs, measuring the inertial values used to calculate the aforementioned characteristics, and calculating them.

Thus in the particular case of applying the control device to controlling tilting, the database 16 contains a precise geometrical description of all tracks on which tilting operation is practicable.

As will now be described with reference to FIG. 3, which is a flowchart defining the general operation of a control device according to the invention, the computer 14 compares calculated geometrical characteristics with characteristics stored in the database to identify the rail track on which it is travelling and to determine accurately the location of the rail vehicle on the track.

On the basis of this location, the computer 14 extracts from the database the geometrical characteristics corresponding to the next curve to be negotiated by the vehicle and uses those values to calculate control set points for the controlled elements. Thus in the particular instance of application of the control device to controlling tilting, the computer 14 calculates the optimum tilt angle $\theta$ of the vehicle for improving the comfort of passengers.

Figure 3:
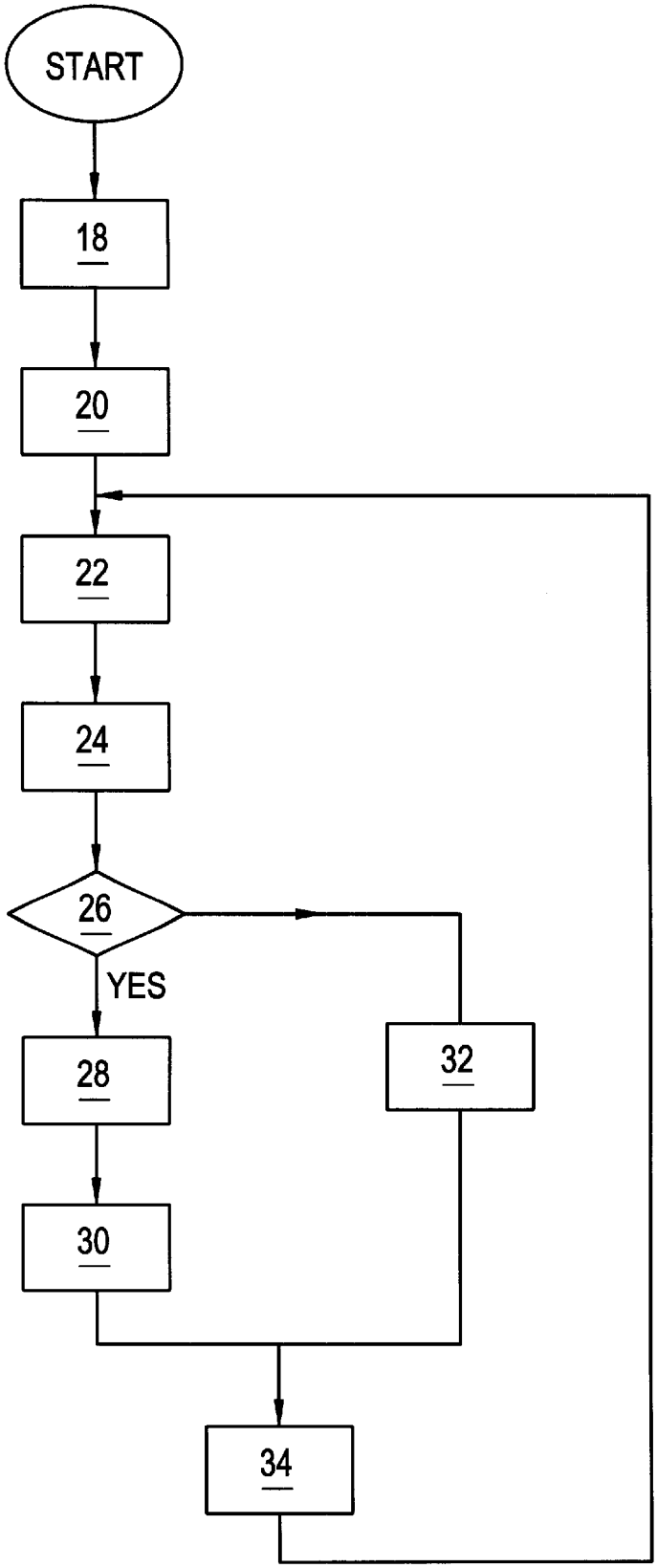
FIG. 3 is a flowchart showing the main phases of the control method according to the invention.

FIG. 3 shows that in a first step 18 the computer 14 receives the inertial values from the measuring means 12 and calculates the geometrical characteristics of the portion of track on which it is travelling from those values using a conventional algorithm.

In the next step 20 it compares the characteristics it has calculated with characteristics stored in the database in order to identify the track on which the vehicle is travelling.

More specifically, during step 20, the computer 14 compares the characteristics obtained when negotiating the preceding three curves with data stored in the database 16.

After the track has been identified, during the next step 22 the computer 14 calculates the distance of the vehicle from the next curve by integrating the speed of the vehicle and from the length of the straight section preceding the curve on which it is travelling.

The geometrical characteristics corresponding to the next curve are then extracted from the database 16 (step 24).

During the next step 26 the location is verified by comparing one or more calculated geometrical characteristics of the curve with a validation window.

The window is generated from geometrical characteristic(s) extracted from the database and corresponding to the location of the vehicle.

If the calculated characteristics are inside the validation window, i.e. if the vehicle has been correctly located, during the next step 28 the geometrical characteristics extracted from the database during step 24 are used to calculate control set points.

In the particular case of using a control method according to the invention to control the tilt of a tilting vehicle, the control set points calculated in step 28 are inclination angle set points.

The angle set points 0 are proportional to the algebraic sum of the transverse components of the acceleration g due to gravity and the centrifugal force and are obtained from the following equation (1):

$$\theta = K\,[V^2/R \cos\alpha - g \sin\alpha] \qquad (1)$$

in which, as previously mentioned:

V is the speed of the vehicle,

R is the radius of curvature of the curve being negotiated, extracted from the database, $\alpha$ is the angle of the cant of the rails, and K is a coefficient of proportionality.

The cant angle a necessarily being small, the above equation can also be written $$\theta = K\,[V^2/R - g.d/1500] \quad (2)$$

in which d is the cant in millimeters and the number 1500 is the distance in millimeters between the rails.

Note that, when the angle set points are calculated during the preceding step 28, to improve the comfort of passengers, in particular in the case of curves with a small radius of curvature, a weighting coefficient extracted from the database 16 is preferably applied to the tilt of the vehicle for each curve by adapting the coefficient K of proportionality accordingly.

The set points are then transmitted to the drive systems equipping each car of the rail vehicle to tilt them at times which compensate the time-delays generated in the operation of such systems, i.e. just before the vehicle begins to negotiate the curve, depending on the location of each car in the vehicle (step 30).

On the other hand, if the characteristics calculated are outside the validation window, indicating that the location determined in the preceding steps 20 and 22 is incorrect, the calculated characteristics of the curve are used to calculate the angle set points in step 32 using the above equation 2. They are then immediately transmitted to the drive systems to control the tilting of the vehicle.

In the next step 34, at least on leaving each curve, the computer 14 corrects the location of the vehicle on the rail track by comparing the geometrical characteristics calculated with characteristic stored in the database to determine precisely the time at which the train begins to leave the curve.

The process then returns to step 22 to calculate the distance between the vehicle and the next curve.

Clearly the control device just described has two separate operating modes, namely a first operating mode in which the inclination angle set points are produced in advance from characteristics extracted from the database 16 and then transmitted to the drive system equipping the vehicle so as to tilt it in phase with the curves over which it is travelling, and a second operating mode which is used if the location determined by the computer using data from the database is incorrect, in which case geometrical characteristics calculated from the measured values are used to calculate the angle set points.

Consequently, even if the location of the rail vehicle cannot be determined, for example because characteristics are not available in the database, it is possible to carry out tilting using the inertial values measured in the curve.

Of course, the control method according to the invention is not limited to the embodiment or the application previously described. To the contrary, the control method according to the invention can be used to control all controlled elements of rail vehicles requiring control in phase with the geometry of the rail track.

Accordingly, in a variant application, the control method according to the invention can be used to control the controlled elements of an active transverse suspension in order to improve the comfort of passengers on the rail vehicle.

An active suspension control method of the above kind then includes the same phases of operation as shown in FIG. 3 and the control device for implementing the method has the same block diagram as shown in FIG. 2. Only the internal calculation of steps 28 and 32 carried out by the computer 14 is modified in order to calculate the values needed to control the active transverse suspension. However, in a similar manner to what has already been described, the step 28 uses geometrical characteristics extracted from the database in step 24 to calculate the control set points for the active suspension and step 32 uses geometrical characteristics calculated in the first step 18 to calculate active suspension control set points. The equations for calculating the active suspension control set points are conventional and are therefore not described in detail hereinafter. Accordingly, if the active suspension of the rail vehicle includes a controlled transverse damper, the calculation effected in steps 28 and 32 provides the damping coefficient to enable the rail vehicle to negotiate the curve most comfortably, for example.

A control method of the above kind applied to controlling an active transverse suspension significantly improves the comfort of the vehicle by enabling the active suspension to react in phase with the curve, so avoiding the phenomena of yaw and roll that can be generated by a phase difference between the reaction of the active suspension and the position of the vehicle in the curve.

Accordingly, in another variant application, the control method according to the invention is used to control the positioning of orientable axles of a bogie. In this case the control method and the control device for implementing the method are identical to those previously described and only the equations for the internal calculations of steps 28 and 32 are different, to provide control set points for the orientable axles enabling them to track the radii of curvature of the curves. A control method of the above kind for orientable axles then enables movement of the axles in phase with the curve being negotiated, which considerably reduces the forces and friction between the axles and the rail track and therefore wear of the latter.

Clearly, regardless of the application of the control method according to the invention, the method provides two separate operating modes of the control device, namely a first operating mode in which control set points are generated in advance from characteristics extracted from the database 16 and then transmitted to the drive system equipping the vehicle to cause the controlled elements to react in phase with the curves on which it is travelling and a second operating mode used in the situation where the location determined by the computer using data from the database is incorrect, in which case geometrical characteristics calculated from measured values are used to calculate control set points.

Consequently, even if the location of the rail vehicle cannot be determined, for example because characteristics are unavailable in the database, it is possible to control the controlled elements using inertial values measured in the curve. Accordingly, during phases of starting the rail vehicle, the control method can cause the rail vehicle to operate in accordance with the second operating mode until the location of the vehicle is determined dynamically by comparing measured values with values from the database.

It is also clear that the invention just described has the advantage of being economical to implement and does not require the sophisticated and costly resources habitually used to determine the instantaneous location of the rail vehicle, such as providing beacons along the tracks, the location of the moving vehicle being determined by comparing characteristics calculated from measured inertial values with characteristics in the database.

Finally, the invention does not require any manipulation or input of data on the part of the driver to determine the location of the rail vehicle and is therefore insensitive to driver error.

What is claimed is:

1. A method of controlling controlled elements of a rail vehicle, including calculating descriptive geometrical characteristics of a rail track by measuring inertial values on board the vehicle and generating control set points for said controlled elements from said characteristics, comprising the steps of:

determining a location of the vehicle on the rail track on which said vehicle is travelling by comparing calculated geometrical characteristics with geometrical characteristics stored in a database and obtained by a learning process;

extracting geometrical characteristics corresponding to a next curve from the database; and generating control set points for the controlled elements from the extracted characteristics prior to said vehicle arriving at said next curve.

2. The control method according to claim 1, wherein before generating the control set points of the connecting elements, at least one of the calculated geometrical characteristics is compared to a window for validating the location of the rail vehicle generated from the respective data extracted from the database and corresponding to a presumed location of the rail vehicle, and if there is no correspondence between the geometrical characteristics calculated and the validation window, control set points for the controlled elements are generated from the calculated geometrical characteristics.

3. The control method according to claim 1, wherein said determining the location of the vehicle comprises identifying the rail track on which the vehicle is travelling by comparing the calculated geometrical characteristics with characteristics stored in the database and calculating the distance to the next curve based on a measured speed of the rail vehicle and a length of a straight section preceding said curve extracted from the database.

4. The control method according to claim 3, wherein at least on leaving each curve, the location of the vehicle on the rail track is corrected by comparing geometrical characteristics calculated while negotiating the curve with characteristics stored in the database.

5. The method according to claim 1, further comprising a step of transmitting the control set points to the controlled elements equipping each car of the rail vehicle at times that enable compensation of the time-delays generated in the operation of said controlled elements and depending on the location of each car in the vehicle.

6. The control method according to claim 1, wherein the controlled elements are elements of an active suspension.

7. The control method according to claim 1, wherein the controlled elements control a position of orientable axles of a bogie.

8. The control method according to claim 1, wherein the controlled elements control a tilt of a tilting rail vehicle, and the control set points are inclination angle set points.

9. The control method according to claim 8, wherein a weighting coefficient for the inclination of the rail vehicle for each curve extracted from the database is applied to the angle set points.

10. A device for controlling controlled elements of a rail vehicle, of the type comprising:

means for measuring inertial values; and a computer adapted to, (a) calculate descriptive geometrical characteristics of the rail track on which the vehicle is travelling from the measured inertial values, and (b) generate control set points for the controlled elements from the geometrical characteristics calculated, the computer comprising, (i) means for determining the location of the rail vehicle by comparing the geometrical characteristics calculated with geometrical characteristics stored in a database stored in the computer and obtained beforehand by a learning process, and (ii) control set points for negotiating the next curve being generated in advance from characteristics of that curve extracted from the database to control said controlled elements in phase with the curve.

11. The control device according to claim 10, wherein said controlled elements control an inclination of a tilting rail vehicle and the control set points are inclination angle set points for the rail vehicle.

12. The control device according to claim 10, wherein the controlled elements are elements of an active transverse suspension.

13. The control device according to claim 10, wherein the controlled elements control a position of orientable axles of a bogie.

14. The method of claim 1, said comparing comprising a step of comparing characteristics obtained when negotiating three previous curves to said geometrical characteristics stored in said database.

15. The method of claim 3, wherein calculating said distance to said next curve comprises calculating said distance by integrating a speed of said vehicle and from a length of a straight section preceding a curve on which said vehicle is travelling.

16. The method of claim 10, further comprising a weighting coefficient that is extracted from said database when said curve has a small radius of curvature in order to modify a tilt of said vehicle.

17. The device of claim 12, further comprising a controlled transverse damper that provides a damping coefficient to modify a tilt of said vehicle.

* * * * *